United States Patent [19]

Rivertz

[11] 4,310,052

[45] Jan. 12, 1982

[54] OFFSHORE STRUCTURE FOR PRODUCTION OF HYDROCARBONS

[75] Inventor: Johan A. Rivertz, Oslo, Norway

[73] Assignee: A/S Hoyer-Ellefsen, Oslo, Norway

[21] Appl. No.: 182,788

[22] Filed: Aug. 29, 1980

Related U.S. Application Data

[63] Continuation-in-part of Ser. No. 68,678, Aug. 22, 1979, abandoned, which is a continuation-in-part of Ser. No. 922,449, Jul. 6, 1978, abandoned, which is a continuation of Ser. No. 815,831, Jul. 14, 1977, abandoned.

[51] Int. Cl.[3] ..... E02B 17/02; E21B 41/00

[52] U.S. Cl. ..... 166/362; 166/341; 166/366; 405/203; 405/224

[58] Field of Search ..... 405/195, 196, 201–208, 405/222, 224, 225; 114/264; 166/338, 339, 341, 351, 362, 366; 175/5

[56] References Cited

U.S. PATENT DOCUMENTS

| | | | |
|---|---|---|---|
| 2,317,016 | 4/1943 | Allen | 405/222 |
| 2,756,021 | 7/1956 | Townsend et al. | 405/208 |
| 3,355,899 | 12/1967 | Koonce et al. | 405/202 |
| 3,545,539 | 12/1970 | Manning | 166/356 |
| 3,693,363 | 9/1972 | Van Den Kroonenberg | 405/201 |
| 3,788,396 | 1/1974 | Shatto et al. | 175/5 |
| 3,789,921 | 2/1974 | DeChassy et al. | 166/366 X |
| 3,849,994 | 11/1974 | Seabourn | 405/208 |
| 3,870,010 | 3/1975 | Wright | 405/205 |
| 3,871,184 | 3/1975 | Schirtzinger | 166/366 X |

*Primary Examiner*—David H. Corbin
*Attorney, Agent, or Firm*—Larson and Taylor

[57] ABSTRACT

An offshore structure for the production of hydrocarbons is constructed and arranged to rest on a base over predrilled wells in a sea bed. A moveable base plate closes the base. Attached to the base plate are a plurality of conductors which are placed in fluid communication with the predrilled wells. During positioning of the structure on top of the predrilled wells, the base plate is moveable to facilitate mating of the base plate with the predrilled well. After the base plate is in place, the base is lowered into engagement with the base plate.

9 Claims, 5 Drawing Figures

OFFSHORE STRUCTURE FOR PRODUCTION OF HYDROCARBONS

This application is a continuation-in-part of this inventor's prior U.S. application Ser. No. 68,678 filed Aug. 22, 1979, now abandoned, which is a continuation-in-part of U.S. application Ser. No. 922,449, filed July 6, 1978, now abandoned, which in turn is a continuation of U.S. application Ser. No. 815,831, filed July 14, 1977, now abandoned.

The present invention relates to a marine structure which is built in sheltered waters and floated out to an offshore location where the structure is ballasted so as to sink down on to the sea bed. More particularly, but not exclusively, the present invention relates to a gravity-structure comprising at least one cell intended to project up from the sea bed and preferably above the sea level when the structure is submerged in its operating position. Further, the present invention relates to a method of installing such a marine structure on the sea bed.

With the advent of offshore oil operations a multitude of problems and expensive necessities and procedures has arisen in connection with marine equipment employed and methods used in the constructions of platforms and the installation procedures of offshore structures and offshore wells. Experiences have shown that expenses are becoming prohibitive, mainly because of the unduly long time required between the discovery of a commercial oil field and the first production of oil, but also because of greater difficulties etc. than originally expected.

One preferred method of approach for exploiting an offshore area has been to explore the field and if the field is found to be of commercial interest, the next step is to order a production platform designed for that particular field. Upon completion, the platform is towed out to the desired location of the field and installed. Finally, the platform is founded and the drilling of the wells can start.

It has previously been proposed to use a gravity structure consisting of a cellular base and a superstructure projecting up from the base and above the sea level, supporting a deck for drilling and production of hydrocarbons. The gravity structure is equipped with a downwardly open foundation of skirts which are pressed down into the sea bed during the installation of the structure. Upon completion of the installation work and additional work on the deck, the drilling of the wells is started, preferably by drilling through one or more of the cells in the superstructure. Several wells, for example up to 30–60 wells, are then drilled from the platform.

Presently the time required for drilling 30–60 wells may be up to 1–2 years which adds up to the time taken for constructing and installing the platform. Thus, the time taken from ordering the platform until oil is produced may be up to five years.

Further, in order to enable the marine structure to be placed on the exact location, it has been proposed to use pile means rigidly attached to the base of the marine structure. The pile means, which preferably are formed as piles, are designed to withstand the forces caused by the tendency of the structure to move horizontally during the initial stage of the installation. During the submergence of the marine structure the pile means engage the sea bed before the base and if the structure at this stage is moving in a lateral direction, the pile means will initially plough a furrow in the sea bed and thereby slow down the lateral motion. If the submergence of the marine structure is halted at this stage the pile means may be used as restraining means, whereby a controlled lateral movement of the marine structure can be achieved. Hence, it is possible to emplace the structure on a predetermined specific location on the sea bed. Exact positioning of the structure may also be achieved by using winches. Both these two procedures have previously been successfully used when emplacing offshore structures in the North Sea.

One of the main objects of the present invention is to provide a method of installation and a platform for use in the method wherein the required time from ordering the platform until oil is produced, is reduced as much as possible.

According to the present invention this is mainly achieved by drilling offshore wells preferably at the same time as the platform is built in sheltered waters.

According to the main idea of the present invention, the platform is built and preferably completed in sheltered waters. Preferably, the platform is equipped with a completed production arrangement and with the major parts of the conductors installed, so that production may start a few weeks after the installation and the founding of the structure is completed.

While the construction of the platform is in progress, a semi-submersible platform may be in operation at the oil field, drilling and completing the required number of wells.

Upon completion of the platform it is then towed out to location, submerged to a depth just above the sea level and maneuvered into exact position over the predrilled wells. The platform is then finally lowered down onto the sea bed in exact position over the predrilled wells and founded.

The present invention is particularly, but not exclusively, useful in connection with a gravity structure comprising a plurality of cells for oil storage. Such a structure should in addition preferably comprise an upper structure projecting above the sea level, which in turn supports a deck structure. The upper structure, which may be formed by elongating one or more of the cells of the base, is intended to house conductors extending from the wells at the sea bed to the process equipment on the deck.

According to the present invention, the pre-drilled wells on the sea bed are clustered together and terminated just above the sea bed by means of a sub-sea template, preferably of concrete, resting on the sea bed. The wells are equipped with valves at the upper end in connection with the template. However, these valves do not form a part of the invention and thus will not be described or shown in detail. The platform is equipped with means intended to be connected with the template when the platform is installed. Further, as previously mentioned, conductors are arranged inside at least one of the cells forming the superstructure. These conductors are preferably preinstalled prior to towing out to location. During tow-out and submergence the conductors may be temporarily suspended in an elevated position. At the lower end the conductors are equipped with a base, for example, of concrete. The shape of the base corresponds to the shape of the template. The pre-installed conductors are in addition arranged in a pattern corresponding to the pattern of the clustered wells on the sea bed.

In order to ensure that the plate at the lower end of the conductors is centered in the desired location on the template, the plate and the template are equipped with centering devices.

During the installation phase, the platform may be guided into position by means of television cameras and/or by means of guide lines or similar means, in order to ensure a correct position of the platform on the template.

The following procedure may be used during the later stage of the platform installation:

Firstly, the platform is towed in a position roughly over the predrilled wells or template, whereafter the platform is lowered down towards the sea bed. The cell(s) containing the conductors is preferably kept dry. When the platform is at a predetermined depth, for example 3–10 m above the template, then the submergence is halted. The platform is then maneuvered into exact position above the template and water is pumped or sluiced into the cell(s) containing the conductors in order to compensate for any optional pressure differences between the cell and the surrounding water. Finally, the temporarily suspended conductors with the base plate are lowered so that the base plate comes into contact with and is centered on the template by means of the centering devices. Both the base plate and the template may optionally be equipped with interlocking means. When a proper contact between the base plate and the template is obtained, the platform is lowered further down and the foundation means, if any, is pressed into the sea bed, supporting the platform. The space between the sea bed, the cell wall(s) and the base/template is then grouted when the penetration of the platform finally has terminated. The purpose of the grouting is to produce a water tight seal between the sea bed and the cell so that water alternatively may be pumped out of the cell(s).

In order not to "lose" any buoyance during towing and submergence, the lower end of the cell(s) in which the conductors are suspended may be equipped with a ring beam, a peripheral console or the like. The lower side of the ring beam is preferably at a distance at least corresponding to the height of the base with its centering means above the lower end of the cell. The lower surface of the ring beam is preferably equipped with sealing means of conventional type.

During the towing and submergence operations of the platform a reduced pressure is kept temporarily inside the cell compared with the external water pressure. The pressure difference presses the base plate against the low surface of the ring beam, ensuring a water tight connection between the base plate and the cell wall and producing a temporary closure of the cell. Alternatively, the base plate may at its surface be equipped with sealing means or, both the base plate and the ring beam may be equipped with sealing means. The base plate and the ring beam may optionally be equipped with interlocking means.

Upon the termination of the grouting operation water may be pumped out of the cell so that any connection work or installation work may be executed in atmospheric conditions.

It should be appreciated that the temporarily suspended conductors with the base plate also may be moved in transverse direction relative to the ring beam and/or rotated about its vertical axis.

The above and other important features and advantages of the present invention may best be understood from the following detailed description, constituting a specification of the same, when considered in conjunction with the drawings, wherein.

Figure 1:
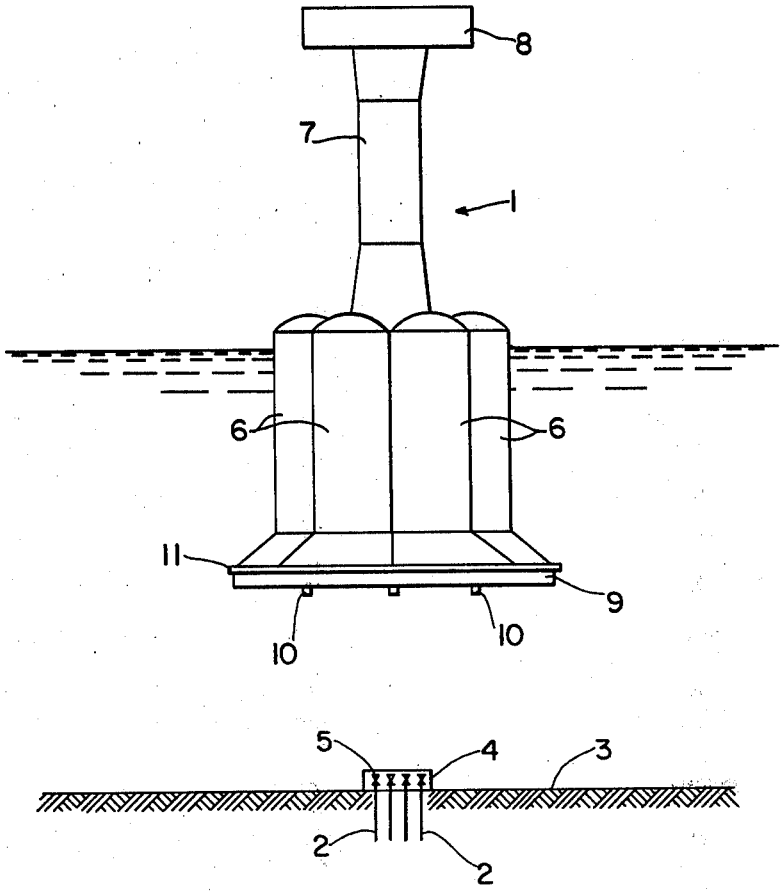
FIG. 1 shows a schematic view of a platform in an approximately correct position over pre-drilled wells.

FIG. 1 shows a schematic view of a platform 1 in an approximately correct position over pre-drilled wells 2 which are terminated just above the sea bed 3 by a template 4. Each of the wells is equipped with conventional valves 5 at their upper end. The platform 1 comprises a base consisting of a number of cells 6. One of these cells 6' is extended upwards to form an upper structure 7 which supports a deck 8. In addition, the platform is equipped with a foundation system consisting of a plurality of skirts 9. In addition, the structure may be equipped with dowels 10 which are intended to decelerate any horizontal motion of the platform during the foundation phase.

The cell forming the upper structure 7 extends preferably from the base slab 11 and up to the deck. Preinstalled conductor pipes 12 are temporarily suspended in an elevated position inside the cell 6' (see FIGS. 2 and 3).

Figure 2:
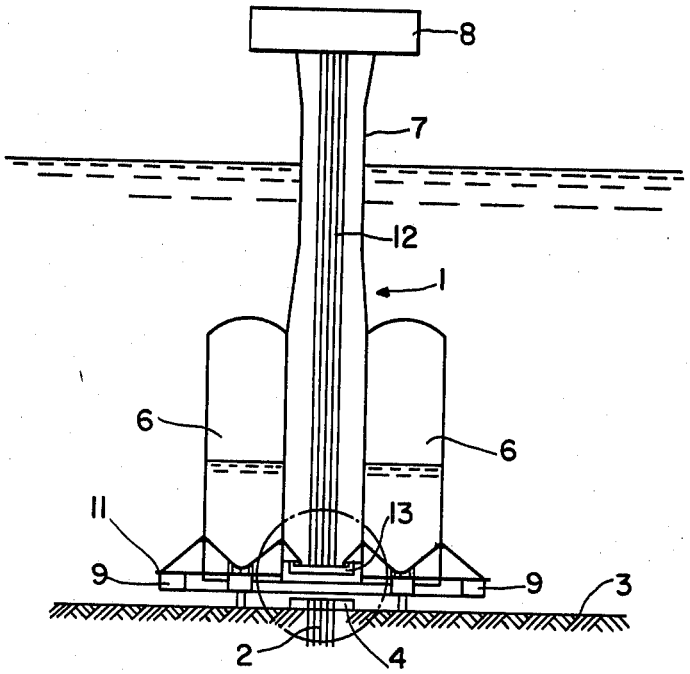
FIG. 2 shows a vertical section through the same platform just prior to the lowering of the conductors with the base plate.

FIG. 2 shows a vertical section through the platform 1 just prior to the lowering of the suspended conductors 12. The conductors 12 are at their lower end terminated by a horizontal base plate 13. It should also be noted that each conductor preferably is closed at its lower end by a valve 14 (see FIG. 3).

Figure 3:
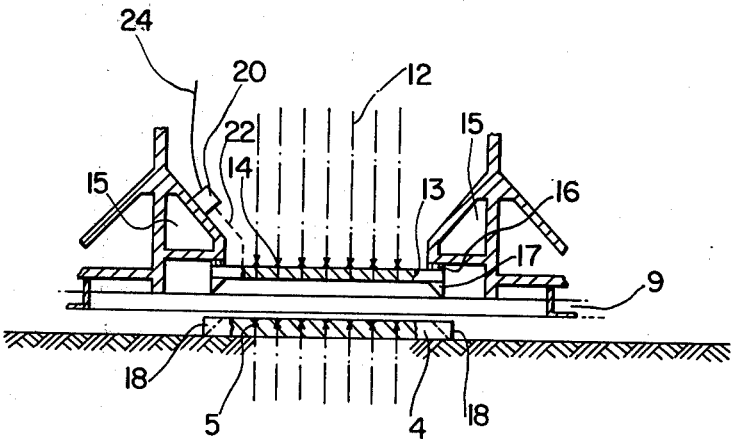
FIG. 3 shows in more detail the vertical section lying within the circle on FIG. 2.

As shown in FIG. 2 or 3, the cell 6' is air filled. Due to an excessive external pressure, the base plate 13 is pressed up against a ring beam 15 or a peripheral console thus forming a temporary bottom in the cell 6'. The upper surface of the base plate 13 and/or the lower surface of the ring beam is preferably equipped with conventional sealing devices 16, so as to prevent water from leaking into cell 6' when air filled.

The base plate 13 is at its lower end equipped with centering devices 17 while the upper end of the template 4 is equipped with corresponding centering devices 18.

An arrangement for moving base plate 13 is shown schematically in FIG. 3. This arrangement includes a mechanical actuator, indicated at 20, which is connected to base plate 13 by a suitable mechanical linkage 22. Mechanical actuator 20 can be remotely controlled from the platform by remote control signals provided on control line 24 which would be connected to a control console on the platform. Mechanical actuator 20 can take any of a number of forms which would provide movement of linkage 22 (or a plurality of such linkages) so as to provide the desired movement of base plate 13 described below, whether lateral, vertical or rotational. Given the mechanical movement to be effected, a number of techniques and designs can be used. Further, lateral movement of base plate 13 could also be provided, for example, by a winch system, a hydraulic or pneumatic jack system, a motor trolley system or simply by "skidding" the base plate in the desired position.

Further, lowering of the base could, of course, be effected by a simple winch.

Figure 4:
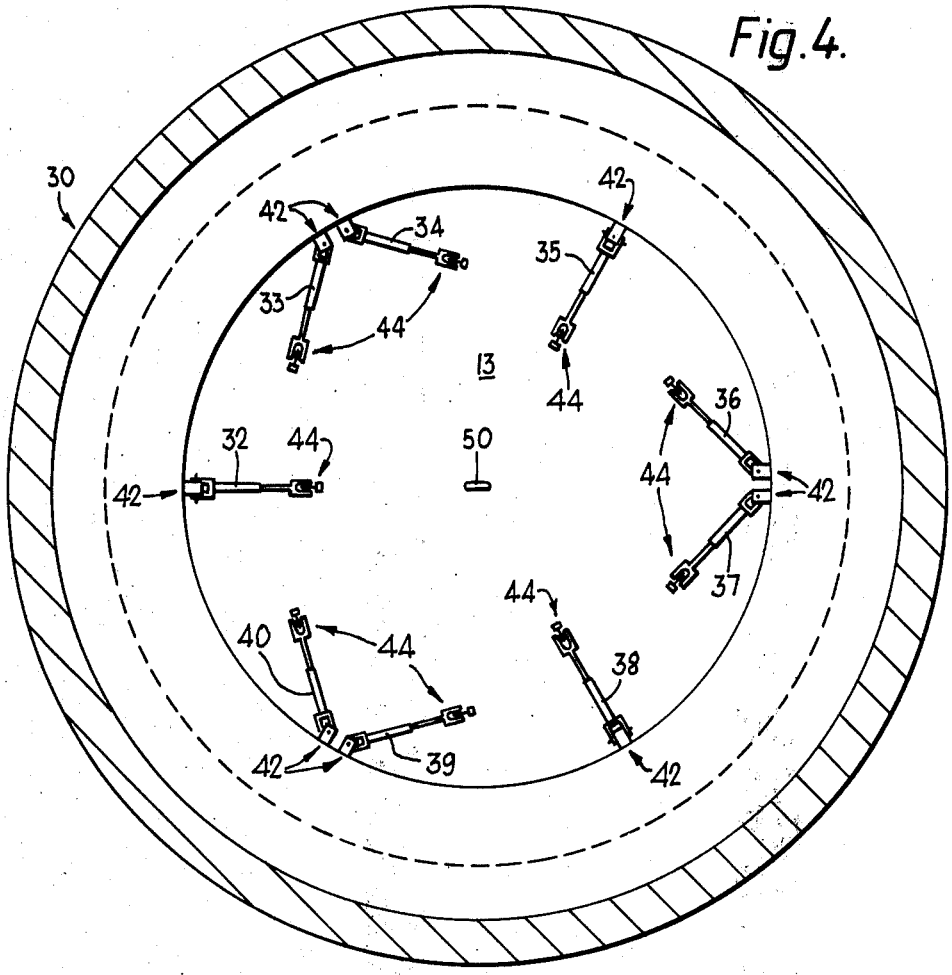
FIG. 4 shows a schematic view of a moving means for the horizontal base plate.
Figure 5:
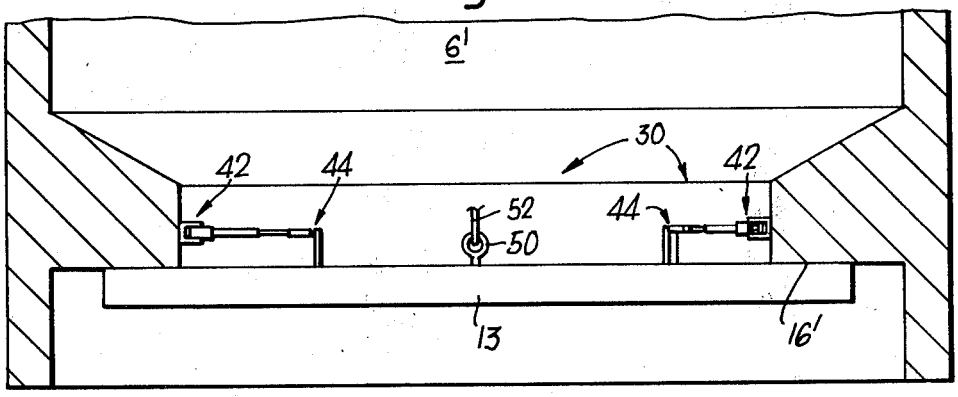
FIG. 5 shows a side view of the moving means depicted in FIG. 4.

Shown in FIGS. 4 and 5 is a hydraulic jack assembly 30 for moving base plate 13 in both a rotational and a radial direction. In this embodiment, sealing device 16 is a sliding face and seal which also allows base plate 13 to slide relative to cell 6'. A suitable sliding face and seal can be constructed in the same manner as for sliding shuds in hydroelectric power plants. Jack assembly 30 is comprised of a plurality of double action hydraulic jacks 32 to 40. Each hydraulic jack is attached at one end to cell 6' by a universal joint 42 and at the other end by a second universal joint 44 to base plate 13. In order to move base plate 13 in a radial direction, hydraulic jacks 32, 35, and 38 are used. When it is desired to move base plate 13 in a rotational direction, hydraulic jack 33, 34, 36, 37, 39 and 40 are used. Universal joints 42 and 44 are needed where base plate 13 is to be moved vertically as well. In order to move base plate 13 vertically, an eyelet 50 and cable 52 are provided. Cable 52 is attached to a suitable winch (not shown) located lon deck 8. Additional winches, eyelets or cables are provided as needed.

According to the present invention, the following procedure may be used during the installation of the platform.

Firstly, the platform 1 is towed into a position roughly over the pre-drilled wells 2 and the template 4, whereafter the platform is lowered down towards the sea bed 3 by adding ballast to the cells 6. During these operations, the cells(s) 6' is preferably kept dry. When the platform is at a predetermined height above the template 4, the submergence is halted. The platform is then maneuvered into exact position above the template 4. Water is then pumped into the cell 6' in order to level out any pressure difference between the cell 6' and the sea. When the pressure difference is levelled out the temporarily suspended conductors 12 with the base plate 13 are lowered down so that the base plate 13 comes into contact with and is centered on the template 14 by means of the centering devices 17, 18. As shown in FIG. 5, base plate 13 can be lowered by winch cable 52 which is attached to eyelet 50.

When the proper contact between the base plate 13 and the template 4 is obtained, the platform is lowered further down and the foundation means 9 are pressed into the sea bed so as to support the platform. The space between the sea bed 3, the walls of the cell 6', the template/base plate and the ring beam 15 is then grouted when the penetration of the platform finally has halted. In this way, a water tight seal at the lower end of the cell 6' is obtained. Water may now optionally be pumped out of the cell 6' so that any work may be executed in atmospheric condition.

It should be appreciated that because of the possibility of keeping the cell 6' at least partly dry, it is possible to maintain a proper buoyancy and stability of the platform even during the submergence of the structure in the region where the top of the cells 6 are just about to dip into water.

It should also be appreciated that the base plate 13 may be moved in either or both a lateral direction or a rotational direction about a vertical axis. Where base plate 13 is to be positioned on template 4 by use of hydraulic jacks 32 to 40, the pressure on sliding face and seal 16' may produce large friction forces which tend to prevent movement. In order to ease these friction forces, the pressure exerted on seal 16' can be reduced by pumping ballast water into cell 6' during final installation. In a specific embodiment, ballast water is pumped into cell 6' in an amount such that the maximum water pressure on base plate 13 is in the range of 5 meters, or in other words, the difference between the external water level and the water level inside of cell 6' is about 5meters. During the final installation stage, cells 6 of platform 1 have already been filled with water to partially submerge platform 1. Therefore, in order not to change the floating level of platform 1, the water pumped into cell 6' is taken from the surrounding cells 6. With the pressure on base plate 13 reduced by the water ballast, the total frictional force and displacement resistance from conductors 12 is less than a few thousand tons. Thus, by use of an appropriate control mechanism, the double-action hydraulic jacks 32, 35 and 38 can move base plate 13 in a radial direction and double-acting hydraulic jacks 33, 34, 36, 37, 39 and 40 can move base plate 13 in a rotational direction.

In moving base plate 13 radially, the suitable control mechanism actuates the appropriate expansion or contraction of the hydraulic jacks 32, 35, and 38. It should be appreciated that as one jack is expanded to move base plate 13 radially, at least one other jack is simultaneously contracted. During radial movement, jacks 33, 34, 36, 39 and 40 are left free to expand or contract as needed. Similarly, when base plate 13 is moved in a rotational direction, hydraulic jacks 34, 37 and 40 move in one mode of actuation (i.e. expansion for clockwise movement) while hydraulic jacks 33, 36, and 39 move in an opposite mode of actuation (i.e. contraction). During rotational movement, hydraulic jacks 32, 35, and 38 are left free to expand or contract as needed.

By providing hydraulic jacks 32 to 40 with universal joints 42 and 44 at both ends, it is also possible to lower base plate 13 by winch cable 52 away from cell 6' and to then position base plate 13 on template 4 by use of hydraulic jacks 32–40. If base plate 13 is to be kept in contact with seal 16' at all times, the ends of hydraulic jacks 32 to 40 need only be provided with two dimensional pivots at each end to allow for movement of the hydraulic jacks as base plate 13 is rotated or moved laterally.

It will immediately be understood that the embodiment of the invention as shown in the drawings and described above is meant only to illustrate the inventive thought and that this inventive thought may be varied in a series of ways within the scope of invention as defined in the claims.

It should be noted that the seals 16' of a type which allow lateral movement without causing leakage can also be used in place of seals 16. If these types of seals are used, the base plate 13 is not lowered into contact with the template. Instead, as the entire structure is lowered down on to the template 14, the centering means 17 on the base plate will force the base plate in a lateral direction until proper contact is obtained between the plate 13 and the template 4. By using such a procedure, the shaft inside of upper stage 7 may be kept permanently dry even during the last stage of submergence.

I claim:

1. An offshore structure for production of hydrocarbons and constructed and arranged to be placed on top of pre-drilled wells in the sea bed, said structure comprising a base constructed and arranged to rest on the sea bed, said base comprising at least one cell, at least one of said cells of said base being open at its lower end, a base plate at the lower end of said open-ended cell for closing said lower end of said open-ended cell, means for moving said base plate at least laterally relative to the open lower end of said open-ended cell, a plurality of conductors positioned in said at least one open-ended cell, said conductors being secured at their lower ends to said base plate and having means, including said base plate, for placing said conductors into fluid communication with said pre-drilled wells for conveying hydrocarbons from said wells to an upper portion of said structure such that said base plate, during positioning thereof on top of the pre-drilled well, is moved at least laterally to facilitate mating of said base plate with the pre-drilled well and thereby ultimately to facilitate engagement of said base plate.

2. An offshore structure according to claim 1 wherein said conductors are each provided with valve means adjacent their lower ends.

3. An offshore structure according to claim 1 further including means to move said base plate vertically relative to the lower end of said open-ended cell whereby, in use, said base plate is urgeable upwardly to close said open end by differentiated pressure across said plate.

4. An offshore structure according to claim 3 further comprising a ring beam positioned inside the periphery of the lower end of said open ended cell, said ring beam comprising a surface against which said base plate is urgeable, in use, by differentiated pressure to close said open end.

5. An offshore structure according to claim 3 further comprising sealing means for prividing a water-tight seal between said base plate and the lower end of said open-ended cell.

6. An offshore structure according to claim 1 further comprising means for centering said base plate on a template located on the sea bed.

7. A method of installing an offshore structure on a sea bed on top of a template containing pre-drilled wells comprising the steps of providing an offshore structure comprising a vertically moveable base plate at its lower end, floating said offshore structure into a location above said template, lowering said structure in the sea such that its lower end is located just above said template, lowering said base plate downwardly into contact with said template while the remainder of said structure remains stationary, and subsequently lowering said structure further downwardly onto the sea bed.

8. A method according to claim 7 wherein said template includes a plurality of conduits in fluid communication with said pre-drilled wells and wherein said offshore structure comprises a cell having an open bottom end closed by said base plate, said base plate including centering means for centering said base plate on said template when said base plate is lowered thereonto.

9. A method according to claim 8 wherein said template comprises centering means which cooperate with said base plate centering means for centering said base plate thereon.

* * * * *